US007503228B1

(12) United States Patent
Hsieh

(10) Patent No.: US 7,503,228 B1
(45) Date of Patent: Mar. 17, 2009

(54) ELECTRONIC TORQUE SPANNER

(76) Inventor: Chih-Ching Hsieh, No. 367, Pei Yang Road, Feng Yuan, Taichung Hsien (TW)

( * ) Notice: Subject to any disclaimer, the term of this patent is extended or adjusted under 35 U.S.C. 154(b) by 0 days.

(21) Appl. No.: 11/937,469

(22) Filed: Nov. 8, 2007

(51) Int. Cl.
*B25B 23/14* (2006.01)

(52) U.S. Cl. ..... 73/862.26

(58) Field of Classification Search ..... 73/862.26
See application file for complete search history.

(56) References Cited

U.S. PATENT DOCUMENTS 3,970,155 A * 7/1976 Otto ..... 73/862.26
4,006,629 A * 2/1977 Barrett et al. ..... 73/862.26
6,931,969 B2 * 8/2005 Hsien ..... 81/467
7,104,144 B1 * 9/2006 Hsieh ..... 73/862.21
7,313,990 B1 * 1/2008 Shiao ..... 81/479

* cited by examiner

*Primary Examiner*—Harshad Patel
*Assistant Examiner*—Octavia Davis
(74) *Attorney, Agent, or Firm*—Ming Chow; Sinorica, LLC

(57) ABSTRACT

An electronic torque spanner includes a driving portion having a driving head for engaging a screwing object, and having a connecting segment, and a handle having a connecting space defined by the inner peripheral surface at the opening end of the handle. The connecting segment is engaged with the connecting space. A slot is formed in the connecting segment and a bottom surface defined at the end of the connecting segment. A strain gauge is installed in the bottom surface and crossed over the slot for measuring the torque in the operation of the spanner. A display unit is installed in the handle and electrically connected to the strain gauge for setting, displaying, and warning with signal.

4 Claims, 4 Drawing Sheets

ELECTRONIC TORQUE SPANNER

FIELD OF THE INVENTION

The present invention relates to an electronic torque spanner, and particularly to a measuring structure for electronic torque spanners, in that a high-sensitivity and low error rate measuring value is acquired.

BACKGROUND OF THE INVENTION

Spanners are frequently used in works. Generally, a spanner has a head for driving a screwing object. In some works, it is necessary to control the force applied to the screwing object so as to prevent the spanner or screwing object from damage or giving a proper engaging level to the screwing object so that it can be locked to an object properly. Thus electronic torque spanner is developed.

For example, U.S. Pat. No. 3,970,155 and No. 4,006,629 disclose the typical electronic torque spanners comprising a stain gauge installed at the neck portion of the spanner. When the force applies on the screwing objects, the strain at the neck portion will be measured by the stain gauge. And the signal will be transferred into the torque and shown on the display.

However, those prior arts still have a defect that the measured strain value will be smaller. The torque value will be easily affected by noise and the location of applied force. And some prior art would install the stain gauge at the cave of the neck portion to overcome this problem. This also will reduce the stiffness of the spanner and the spanner will break at the neck portion. Thus there is an eager demand for a novel design which can improve the defect in the prior art.

SUMMARY OF THE INVENTION

Accordingly, the primary object of the present invention is to provide an electronic torque spanner with a slot formed in connecting segment, in that a strain gauge can be installed for measuring the torque accurately and the structure of spanner will not be damaged.

To achieve the above objectives, the present invention provides an electronic torque spanner comprising a driving portion having a connecting segment; a slot formed in the connecting segment and a bottom surface defined at the end of the connecting segment; the slot passes through the bottom surface; a handle having a connecting space defined by the inner peripheral surface of the opening end of the handle; the connecting segment engaged with the connecting space; and a strain gauge installed at the bottom surface and crossed over the slot for measuring the torque in the operation of the spanner.

The stain gauge is installed inside the spanner so that there is no concern for any unguarded impact against the stain gauge. The slot divides the connecting segment into two parts so that the moment of inertia of section is reduced and the strain will be greater during the same acting force. This will result in high sensitivity and low-error rate measuring value without destroying the structure of spanner.

The various objectives and advantages of the present invention will be more readily understood from the following detailed description when read in conjunction with the appended drawing.

DETAILED DESCRIPTION OF THE INVENTION

In order that those skilled in the art can further understand the present invention, a description will be provided in details below. However, these descriptions and the appended drawings are only used for those skilled in the art to understand the objects, features, and characteristics of the present invention, but not to be used to confine the scope and spirit of the present invention defined in the appended claims.

Figure 1:
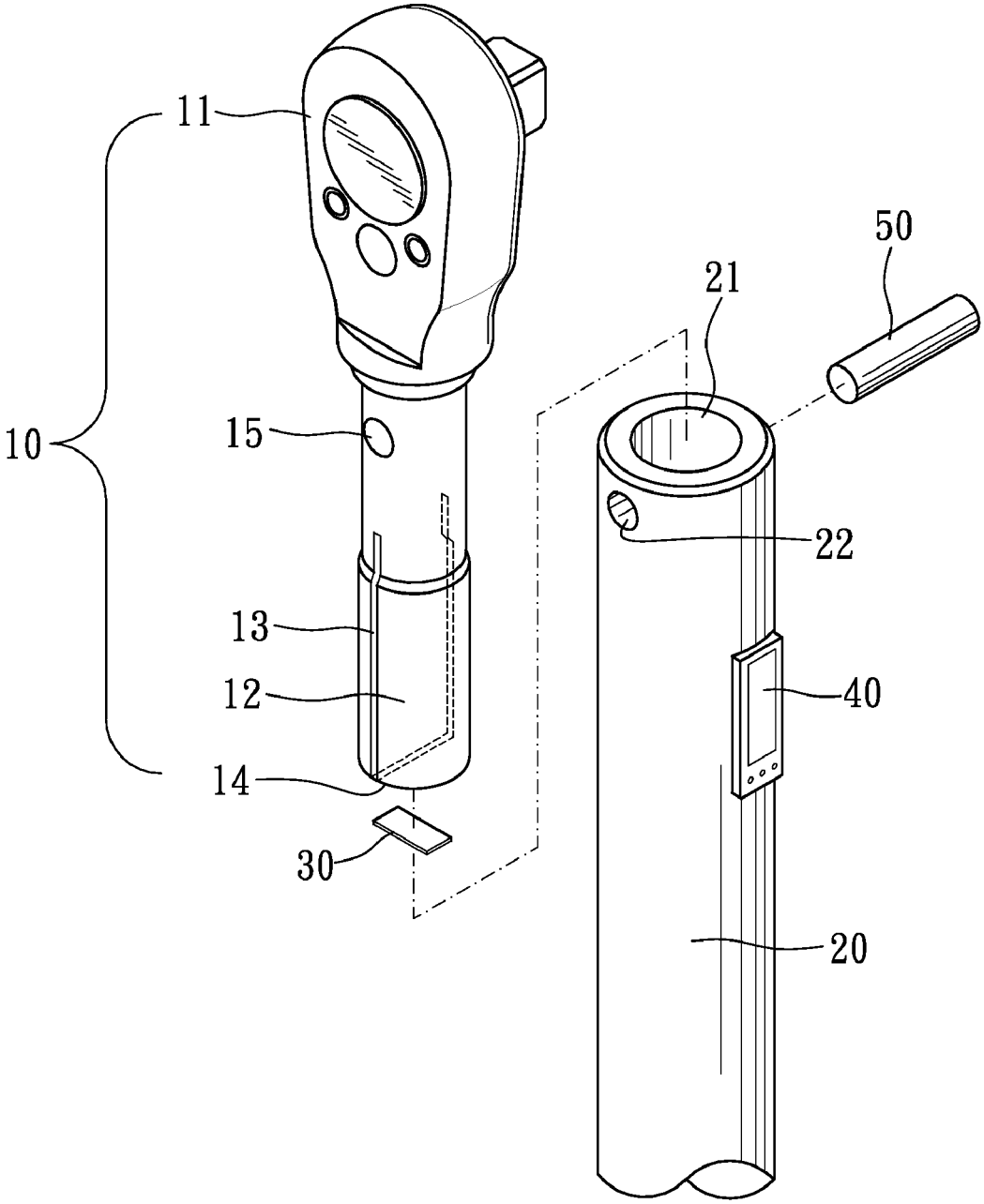
FIG. 1 is a schematic perspective view about the first embodiment of the present invention.
Figure 2:
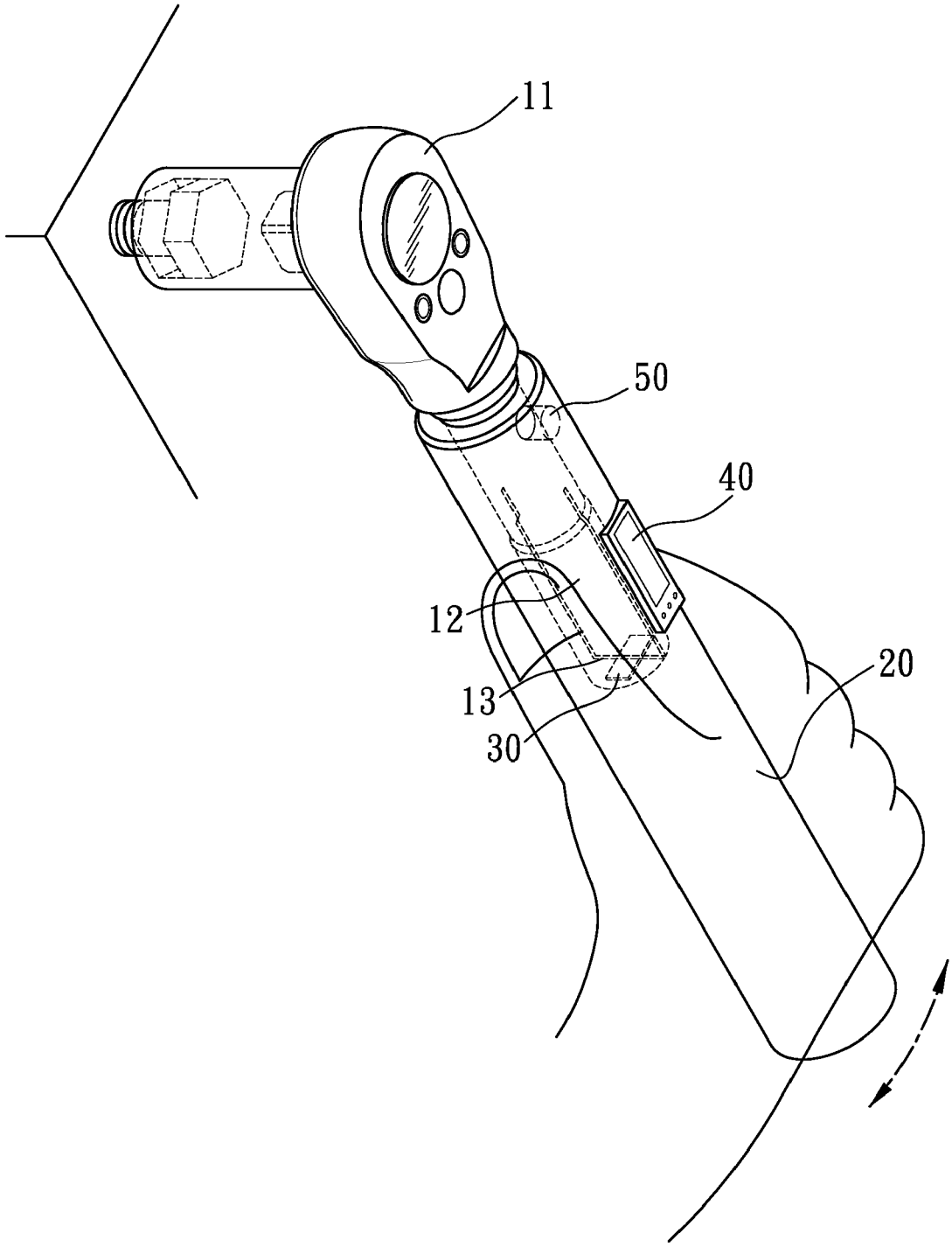
FIG. 2 shows the operation of the present invention.

Referring FIG. 1 and FIG. 2, an electronic torque spanner according to the present invention is illustrated. The present invention has the following elements:

A driving portion 10 includes a driving head 11, such as a ratchet driving head 11 for engaging with and for driving fasteners, tool members, or the like. The opposite of the driving head 11 is a cylindrical connecting segment 12. A slot 13 penetrates the connecting segment 13 and passes the axis of connecting segment 13. The plan surface of slot 13 is perpendicular to the plan surface which the fastener is located on. A bottom surface 14 is defined at the end of the connecting segment 12. The slot 13 passes through the bottom surface 14 and forms two semicircles on the bottom surface 14. A hole 15 is formed between the driving head 11 and the connecting segment 12.

A handle 20 includes a connecting space 21 defined by the inner peripheral surface of the opening end of the handle 20. The connecting space 21 is hollow for receiving the connecting segment 12. A display unit 40 is installed in the handle 20 for setting the default torque value, displaying the current torque value, and warning with beep or flash when the current torque value is reached the default torque value. A hole 22 is formed in the handle 20 for a pin 50 passing through.

A strain gauge 30 is installed in the bottom surface 14 and crossed over the slot 13. The direction of the slot 13 is perpendicular to the measuring direction of the strain gauge 30 for measuring the strain in the operation of the spanner. The strain gauge 30 is electrically connected to the display unit 40.

The driving portion 10 is inserted into the handle 20, so the connecting segment 12 is engaged with the connecting space 21. The pin 50 passes through the hole 22 and hole 15 to fasten the driving portion 10 and the handle 20.

Figure 3A:
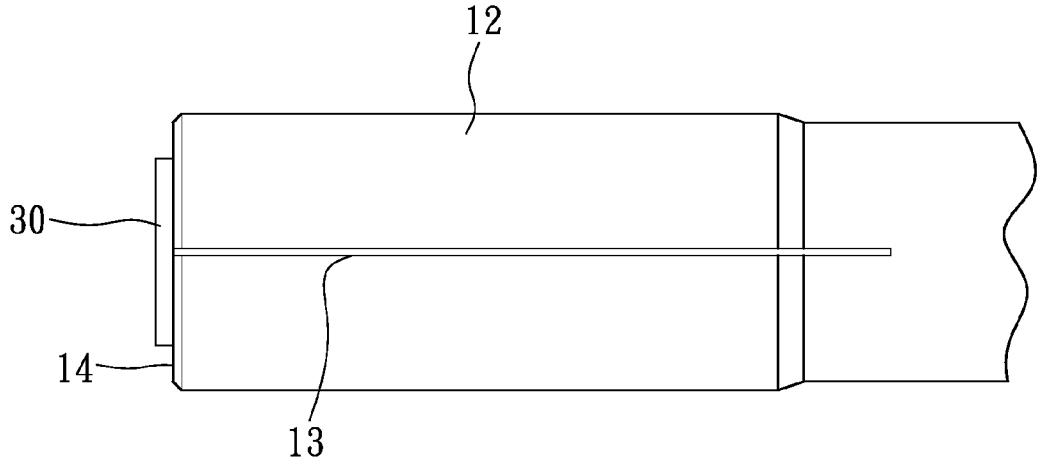
FIGS. 3A and 3B show the enlarged front views of the connecting segment of the present invention.
Figure 3B:
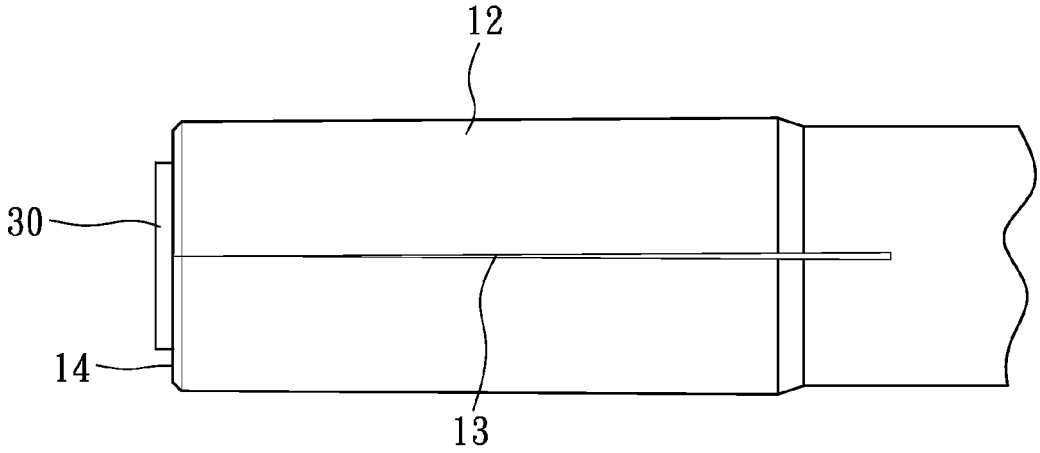

FIG. 3A and FIG. 3B show the enlarged front views of the connecting segment of the present invention. In FIG. 3A, it is illustrated that there is no strain if the clearance of slot 13 is the same. In FIG. 3B, it is illustrated that there is stain in the connecting segment 12 if the clearance of slot 13 is changed.

Figure 4:
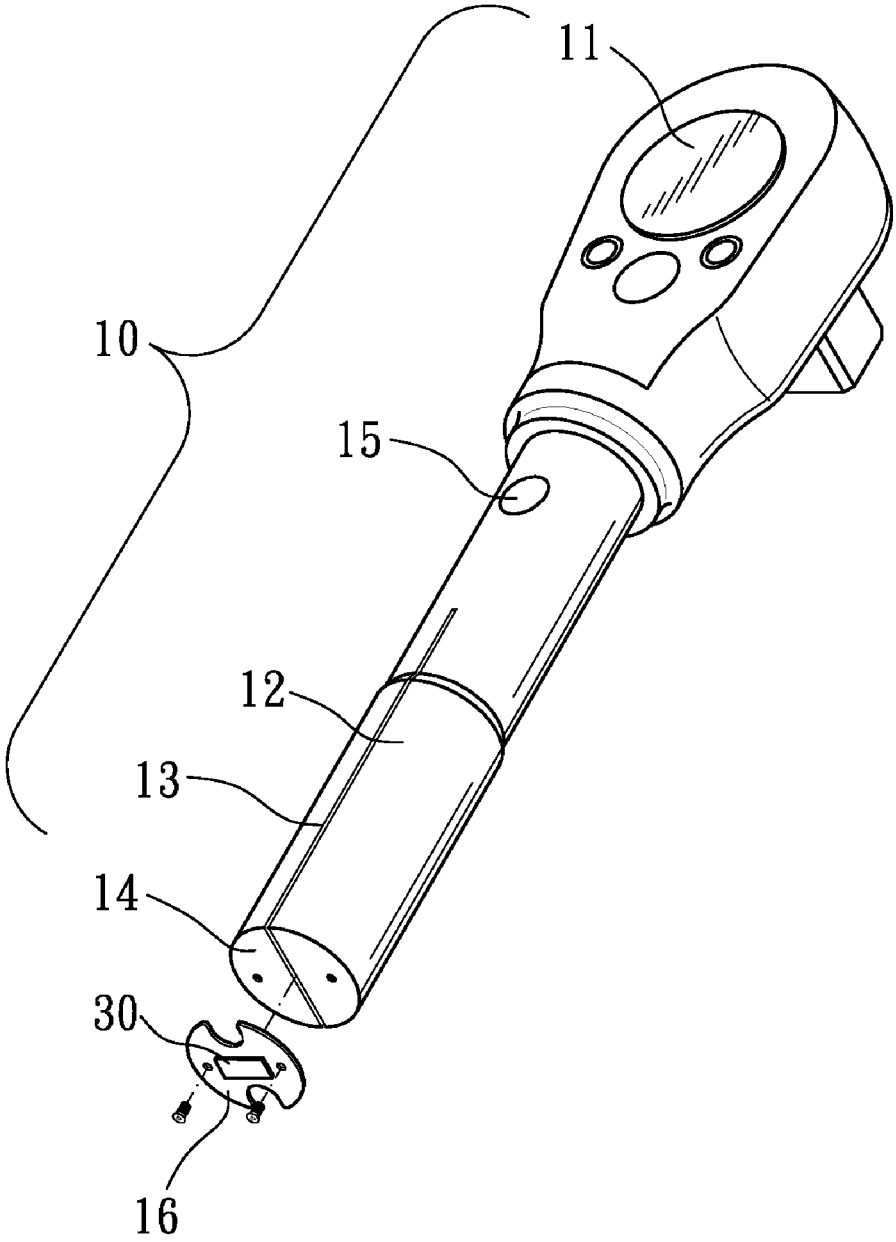
FIG. 4 is a schematic perspective view about the second embodiment of the present invention, in which the handle has been omitted.

FIG. 4 shows the second embodiment of the present invention, in which the handle has been omitted. In this embodiment, those identical to the above embodiment will not be further described herein. Only those different from above embodiment are described. In this embodiment, the strain gauge 30 is installed in a fixing plate 16. The fixing plate 16 with strain gauge 30 is fastened in the bottom surface 14. It will be easier to replace the fixing plate 16 with strain gauge 30 when the strain gauge 30 is damaged.

However, above mentioned embodiments are just examples of the present invention, they are not confined the scope of the present invention. The forms of the handle and head and the location of the slot may be varied as desired.

The present invention is thus described; it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electronic torque spanner comprising:

a driving portion having a connecting segment; a bottom surface defined at the end of said connecting segment; a slot penetrating said connecting segment and passing an axis of said connecting segment, said slot extending to said bottom surface;

a handle having a connecting space defined by the inner peripheral surface of the opening end of the handle; said connecting segment received in said connecting space; and a strain gauge installed in said bottom surface and crossed over said slot for measuring the torque in the operation of the spanner, wherein said slot has a direction perpendicularly corresponding to a measuring direction of said strain gauge;

whereby said slot divides said connecting segment into two parts so that the moment of inertia of section is reduced and the strain is greater during the same acting force for providing a high sensitivity and low-error rate measuring value without destroying structures of said torque spanner.

2. The electronic torque spanner as claimed in claim 1 further comprising a display unit installed in said handle and electrically connected to said strain gauge for setting, displaying, and warning with signal when a current torque is reached a default torque value.

3. An electronic torque spanner comprising:

a driving portion having a connecting segment; a bottom surface defined at the end of said connecting segment; a slot penetrating said connecting segment and passing an axis of said connecting segment, said slot extending to said bottom surface;

a fixing plate fixed on said bottom surface and crossed over said slot;

a handle having a connecting space defined by the inner peripheral surface of the opening end of the handle; said connecting segment received in said connecting space; and a strain gauge installed in said fixing plate and crossed over said slot for measuring the torque in the operation of the spanner, wherein said slot has a direction perpendicularly corresponding to a measuring direction of said strain gauge;

whereby said slot divides said connecting segment into two parts so that the moment of inertia of section is reduced and the strain is greater during the same acting force for providing a high sensitivity and low-error rate measuring value without destroying structures of said torque spanner.

4. The electronic torque spanner as claimed in claim 3 further comprising a display unit installed in said handle and electrically connected to said strain gauge for setting, displaying, and warning with signal when a current torque is reached a default torque value.

* * * * *